US011267534B2

(12) United States Patent
Andersen et al.

(10) Patent No.: US 11,267,534 B2
(45) Date of Patent: Mar. 8, 2022

(54) AUTOMATIC RELEASE SYSTEM ON A SUPPLY OR TUG VESSEL

(71) Applicant: BIFROST TUG AS, Sagvåg (NO)

(72) Inventors: Steinar Andersen, Sagvåg (NO); Bjarne Engen, Bergen (NO)

(73) Assignee: BIFROST TUG AS, Sagvåg (NO)

( * ) Notice: Subject to any disclaimer, the term of this patent is extended or adjusted under 35 U.S.C. 154(b) by 71 days.

(21) Appl. No.: 16/763,538

(22) PCT Filed: Nov. 15, 2018

(86) PCT No.: PCT/NO2018/050274
§ 371 (c)(1),
(2) Date: May 12, 2020

(87) PCT Pub. No.: WO2019/098845
PCT Pub. Date: May 23, 2019

(65) Prior Publication Data

US 2020/0354023 A1 Nov. 12, 2020

(30) Foreign Application Priority Data

Nov. 15, 2017 (NO) ..... 20171812

(51) Int. Cl.
*B63B 21/60* (2006.01)
*B63B 35/68* (2006.01)

(52) U.S. Cl.
CPC ..... *B63B 21/60* (2013.01); *B63B 35/68* (2013.01)

(58) Field of Classification Search
CPC ..... B63B 21/00; B63B 21/04; B63B 21/56; B63B 21/58; B63B 21/60; B63B 35/66; B63B 35/68
USPC ..... 114/242, 249, 252, 253
See application file for complete search history.

(56) References Cited

U.S. PATENT DOCUMENTS 1,592,019 A * 7/1926 Weber ..... B63B 21/56 114/247
4,540,210 A * 9/1985 Smith ..... B63B 21/60 114/252

FOREIGN PATENT DOCUMENTS

| | | | |
|---|---|---|---|
| DE | 1119711 | B | 12/1961 |
| FI | 127026 | B | 9/2017 |
| FI | 20165844 | A | 9/2017 |
| GB | 257515 | A | 9/1926 |
| WO | 8400527 | A1 | 2/1984 |

* cited by examiner

*Primary Examiner* — Daniel V Venne
(74) *Attorney, Agent, or Firm* — Flener IP & Business Law; Zareefa B. Flener

(57) ABSTRACT

Automatic release system on a supply- or tug-vessel, comprising a rotational towing hook (10) supported on a vertical axel (16), for receipt of a towing hawser (12), and a releasing unit for releasing the towing hawser (12) from the towing hook (10). A registration unit (14) is installed above the towing hook (10) working area, said registration unit (14) being a tiltable or liftable hoop plate, where the registration unit (14), under influence of vertical angular movement in the towing hawser's (12) horizontal direction in relation to the towing hook (10), is arranged to trigger release of the releasing unit.

13 Claims, 2 Drawing Sheets

AUTOMATIC RELEASE SYSTEM ON A SUPPLY OR TUG VESSEL

FIELD OF THE INVENTION

The present invention relates to an automatic release system on a supply- or tug-vessel, comprising a rotational towing hook supported on a vertical axel, for receipt of a towing hawser, and a releasing unit for releasing the towing hawser from the towing hook at danger of capsizing the vessel.

BACKGROUND OF THE INVENTION

Supply- and tugboats are required to have a manual distress releaser for releasing the towing hawser. If the towing gear is overloaded and/or the angle between the boat and the towing hawser is wrong, there may be danger of capsizing the boat, with tragic consequences.

For example, the tug is connected to the towing hawser while it is turning the stern against the direction the towed vessels moving, when there suddenly is an acceleration in the tow. Many tugs have not the required stability to prevent capsizing in such cases where the load in the towing hawser increase heavily in the most unfavourable athwart ship direction. The lack of stability necessary may be due to arrangement of towing point mid ship in centre of ship, which makes the tug vulnerable to heeling and capsizing. In such cases, position of the distress release handle may be critical for the operation if too distant from the manoeuvre position. Even if the towing hawser can be released from the actual manoeuvre position there may still be danger of accident with loss of ship.

New rules for tugs and towing now require tug and similar ships to have enough stability to survive towing athwart ship by the tow at speed up to 5 knots. The rules focus on position of the towing point on the ship both longitudinal and athwart ship, thus the position of the towing point will be approved based on the ships stability.

DISCLOSURE OF THE STATE OF THE ART

GB1501613 A refer to a safety system for release of cables from a tugging vessel. This system use electrical signals, which varies proportional with the heeling of the vessel. When an in advanced programmed angle is exceeded, a hydraulic jack is activated to release the towed cable.

FI77621B refer to an automatic release arrangement for automatic release of a towing hook controlled by an instrument/roll sensor for registration of the heeling of the towing vessel.

The referred publications shows release systems acting in accordance to the heeling of the towing vessel for release of the tow.

DE 1119711 B relates to a release system for e.g. a tugboat, comprising a swivel-mounted towing hook for receiving a towing hawser and a trigger for releasing the towing hawser from the towing hook. The system has a pendulum registration unit to detect whether the vessel's trim angle exceeds a limit value and cause trigging of the releaser if said limit value is exceeded. The trim angle is absolute and will be affected by the vessel's stamping, as well as possibly impact from the tow.

FI 127026 B relates to a system for decoupling of a winch associated with a towing hawser using a registration unit mounted above the towing hawser and where the registration unit is registered the towing hawsers vertical angle fluctuations.

OBJECTS OF THE PRESENT INVENTION

It is an object of the present invention to provide a release system for automatic release of the towing hawser from the tug at capsizing danger due to too much heeling and/or trimming caused by the towed vessel.

The release system according to the invention shall not be affected by rolling and pitching due to waves. This is achieved by the invention due to only registration of the angle between the ships vertical axis longitudinal and athwart ship, and the towing hawser/towing hook. The release angle can be adjusted, and may be different for heeling than for trimming with step less continues different angles in between.

The release system shall preferably be mechanical such that there is no dependence on the engine or lack of battery power.

It is at least an object to provide an alternative release system for the towing hawser on a supply- or tug vessel.

The invention comprises for example a registration unit formed as a hoop or arm for registration and transfer of the vertical angle between tug axis and the towing hook/towing hawser, through an adjustable touching or impact point. The registration unit is bearing on the same vertical axis as the towing hook and follow this when it is rotating horizontally and vertically.

The registration and transfer unit may be a vertical sliding bearing with a registration/horizontal transfer plate for the touching, and transfer in a vertical linear motion independent of the towing hooks horizontal position.

Transfer parts may be used for the transition of the movement to a valve, switch, pulling wire, or other item. The transfer parts may be hydraulic, mechanical, or other methods. If hydraulic this may be in the form of a hydraulic cylinder with large diameter connected to the registration/transfer plate with pipe connection to a hydraulic cylinder with small diameter connected to a valve or pulling wire. Thus then the movement will be increased by the proportions of the cylinders to appropriate size for use on the valve or the pulling wire. For mechanical transfer will length of arms have the same increasing effect on the movement.

The release system may be directly mechanic if not too high releasing load, or pneumatic, hydraulic, (electrical), or other solutions for increasing the releasing force. Use of such reinforcing systems may be powered by magazine power ready for use in this system, for example, pressure vessels, accumulators, (batteries), or other stored energy.

SUMMARY OF THE INVENTION

The above mentioned objects are achieved with an automatic release system on a supply- or tug-vessel, comprising a rotational towing hook supported on a vertical axel, for receipt of a towing hawser, and a releasing unit for releasing the towing hawser from the towing hook, wherein a registration unit is installed above the towing hook working area, said registration unit being a tiltable or liftable hoop plate, where the registration unit, under influence of vertical angular movement in the towing hawser's horizontal direction in relation to the towing hook, is arranged to trigger release of the releasing unit.

The towing hawser will in reality during load normally always be with the same angle in relation a horizontal plane or sea level. The towing hawser does not change angle, but the supply- or tug vessel heel over or trims, and the towing hawser is thus used as reference line. The registration unit detects the angle between a vertical axis of the vessel (which is not vertical when the vessel moves) and the towing hawser.

Alternative embodiments are disclosed in the dependent claims.

The registration unit can be triggering release of the releasing unit at predetermined maximum tilt- and trim angles of the vessel dependent on horizontal direction of the towing hawser in relation to longitudinal or transverse axis of the vessel.

The registration unit can be supported on the same vertical axel as the towing hook, and be arranged to rotate together with the towing hook.

The registration unit can in one embodiment be slidable supported on the same vertical axel as the towing hook, and be liftable under influence of said vertical angular movement of the towing hook.

The registration unit can in another embodiment be supported on the same vertical axel as the towing hook, and be tiltable about a rotation point under influence of said vertical angular movement of the towing hook.

The registration unit can be connected with a linked arm connection to the releasing unit for transfer of a releasing force.

The linked arm connection can pull or release a releasing wire connected to the releasing unit.

The linked arm connection can further be arranged to open a valve between an accumulator and a cylinder unit, where the cylinder unit is arranged to activating the releasing unit.

In one embodiment can an impact plate be arranged vertically moveable above the registration unit, where the impact plate is arranged to transfer said angular movement of the towing hook from the registration unit to the linked arm connection.

In another embodiment can an impact plate be arranged vertically moveable above the registration unit, where the impact plate is connected to a hydraulic system, which is arranged to activate a valve which when activated is arranged to release the releasing unit.

The registration unit can be equipped with an upward bolt, where a clearance between the registration unit's bolt and the touch plate provides desired release angle.

The registration unit can be formed as a hoop plate that has a partly spherical geometry on the underside.

A clearance between the registration unit and the towing hook gives a desired release angle.

DESCRIPTION OF THE FIGURES

The preferred construction of the invention will be described more detailed in the attached figures below, wherein.

DESCRIPTION OF THE PREFERRED EMBODIMENT OF THE INVENTION

Manual releasers for towing hooks are fabricated and sold in many variants, both pneumatically, hydraulically, and mechanically solutions, as wire pulling. Common for all solutions are a device for release of the hook, wheel or hasp which is holding the towing hawser are released such that towing hawser is free to go. The trigger for release can be activated from the manoeuvre position and other positions onboard. A releaser system is known by the professionals, and therefore not shown or more described in this application.

Alternatively, a releaser that cuts the towing hawser can be used, for instance a scissor or a knife. Accordingly, the invention can also be used for activating such a cutting mechanism.

The registration unit 14 according to the invention can be a tiltable hoop plate or a similar plate that is liftable and which can be elevated. The liftable plate can be vertically skidable on the same axis or axle as the towing hook. Both embodiments are influenced by movement of the towing hook and the towing hawser. The invention is basically disclosed in relation the tiltable hoop plate, but works just as well with the liftable plate.

Figure 1:
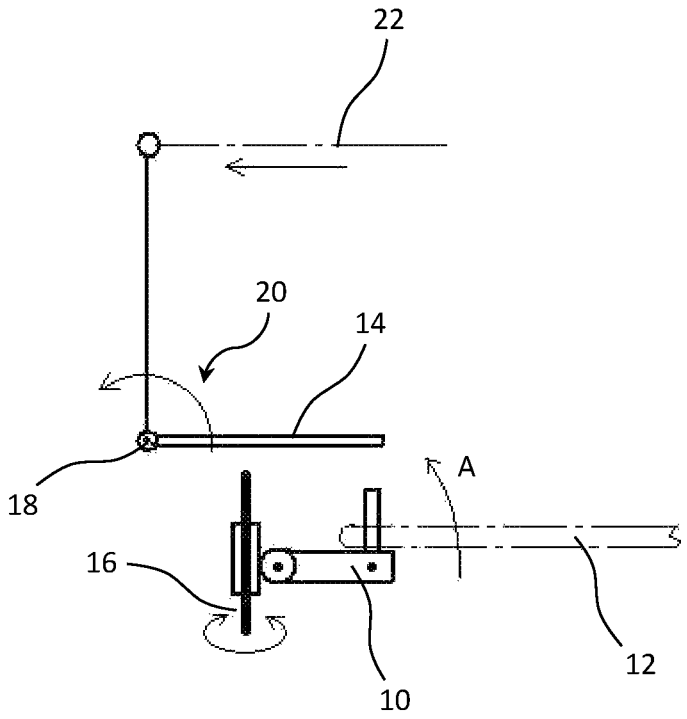
FIG. 1 show a principal sketch of the release system according to the invention.

FIG. 1 shows a principal sketch of a first simple constructed release system according to the invention, and comprises a towing hook 10 which as in common knowledge is supported for rotation around the axel 16. A towing hawser 12 is hooked on the towing hook 10. To let the towing hook 10 release in this example, a pulling wire 22 is used, and when pulled the towing hook 10 is released and let the towing hawser 12 free to go.

Above and in a distance from the towing hook 10 is a registration unit 14 shown, here for example as a hoop plate or arm connected to the same axel 16, such that the registration unit 14 follow the towing hook 10 when this is rotating.

The registration unit is in the following text referred to as a hoop plate 14. The hoop plate may be curved, which means it may have on its underside a spherical geometry. Clearance between the hoop plate 14 and the towing hook 10 will give the release angle, which means that if the angle between the towing hook 10 and the hoop plate 14 is reduced enough, shown with the arrow A, the towing hook 10 will hit and lift up the hoop plate 14. The hoop plate 14 is on the back connected to a linked arm connection 20, which will pull the trigger wire 22 such that the releasing unit is releasing the towing hook 10 and let the towing hawser 12 free to go.

The hoop plate 14 and the linked arm connection 20 may be linked together in the rotation point 18, or connection point in case of a liftable plate, and the length of the transmission arm will then give the length of the wire pulling distance. This way a reference to the tug vessels heeling angle is connected to the direction of the towing hawser vertically. The construction of the release system is adjusted to fit the design of the actual towing hook installed.

Figure 2:
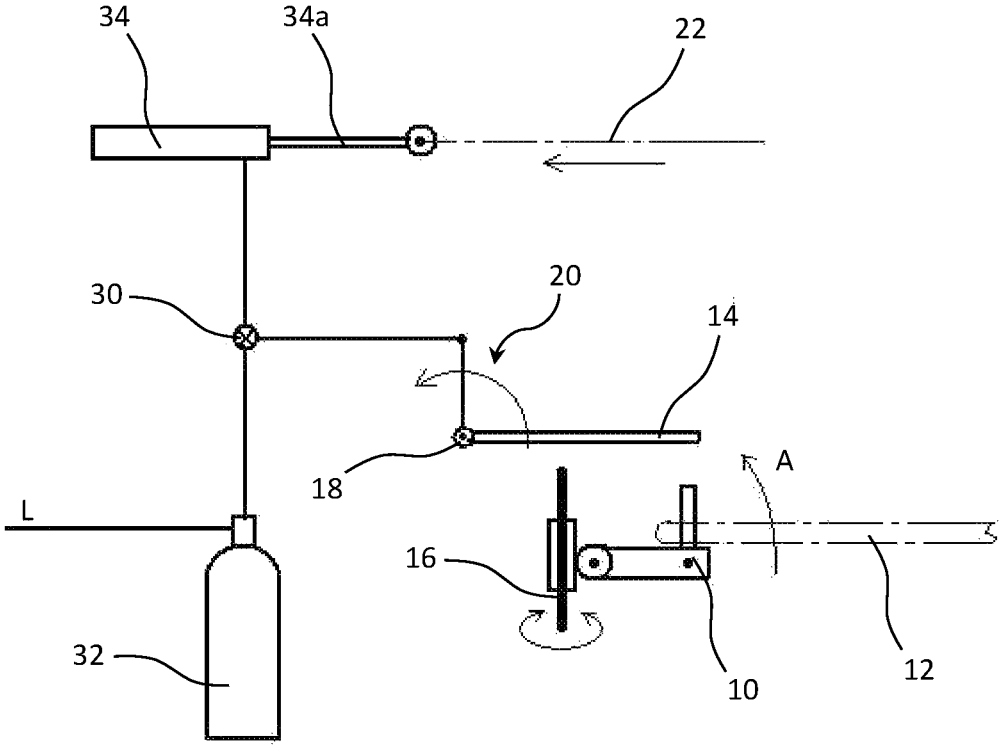
FIG. 2 show a principal sketch of the first version of a pneumatic release system according to the invention.

FIG. 2 shows a principal sketch of another design of a release system according to the invention, where a first solution with a pneumatic system for giving the wire pull pulling force. The towing hook 10, hoop plate 14 and support bearing is as explained above as shown in FIG. 1, or as with the liftable plate. When the hoop plate 14 is moved, the movement is transferred via the linked arm connection 20 to a valve 30. This valve 30 is installed between an accumulator 32 for compressed air or other gas and a pneumatic cylinder 34. When the valve 32 is opened, it activates the pneumatic cylinder 34 such that the piston rod 34*a* pull the wire for trigging release of the towing hook 10.

Figure 3:
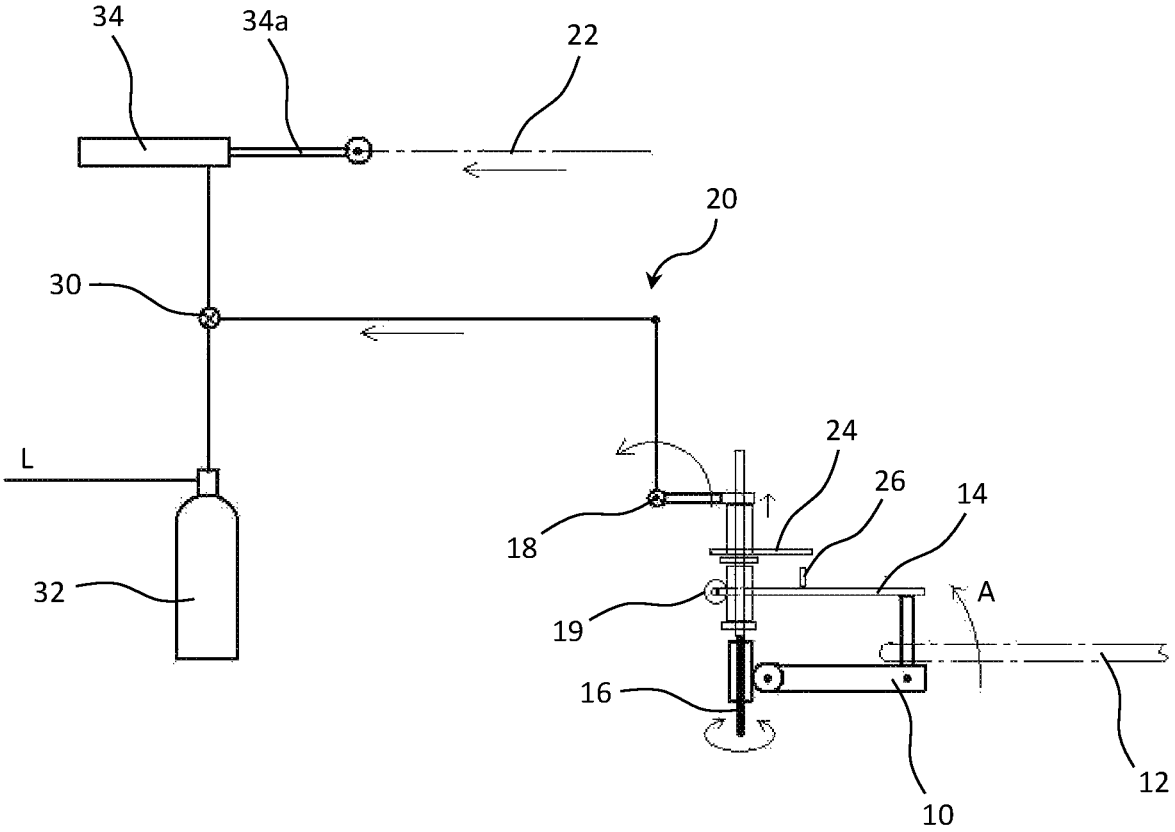
FIG. 3 show a principal sketch of a second pneumatic release system according to the invention.

FIG. 3 shows a principal sketch of a third solution for the release system according to the invention, where a second design for pneumatic system is used for pulling the release wire. The towing hook 10, hoop plate 14 and support bearing is as explained above with respect to the FIGS. 1 and 2, or as with the liftable plate. The hoop plate 14 may be installed such that it is in contact with the towing hook 10. In a distance above the hoop plate 14 is installed a vertical and linear moveable touch or impact plate 24 for transfer of the angle to vertical linear movement independent of the towing hook 10 horizontal position.

The impact plate 24 may have a sliding bearing on the same vertical axel 16 as the hoop plate 14 and the towing hook 10. The impact plate 24 may be formed as explained for the hoop plate 14. Hoop plate 14 may with this form have a vertical bolt 26 where the clearance between the hoop plate 14 bolt 26 and the impact plate 24 give the desired angle for trigging release. The bolt 26 may be adjustable in height, for instance by an adjustable bolt The back of the hoop plate 14 is supported in the rotation point 19, and when the hoop plate 14 flips upwards by the towing hook 10 will the bolt 26 press against the impact plate 24, which via its vertical linear movement will transfer the force to the linked arm connection 20 and valve 30 installed between the accumulator 32 and the pneumatic cylinder unit 34 for trigging release of the towing hook 10.

In both designs shown in FIGS. 2 and 3 may the accumulator 32 be filled by the vessels motor.

Figure 4:
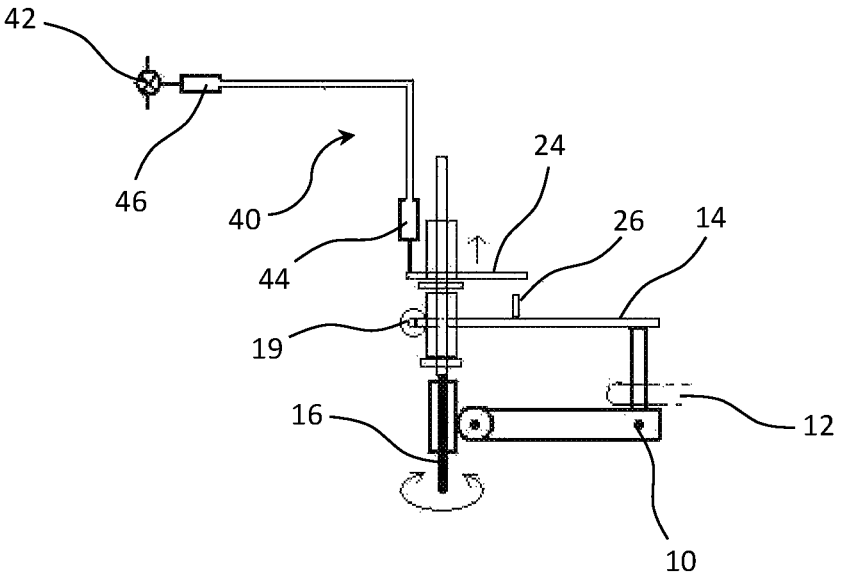
FIG. 4 show a principal sketch of a hydraulic release system according to the invention.

FIG. 4 shows a principal sketch of a fourth design of the release system according to the invention, where a hydraulic system is used for the release. The towing hook 10, hoop plate 14, touch plate 24 and support bearings is as explained above with respect to FIG. 3. When the hoop plate 14 flips up, or is moved vertically, by the towing hook 10 will the bolt 26 be pressed against the touch plate 24 which via its vertical linear movement transfer the force to a hydraulic system 40 for trigging the release of the towing hook 10. The hydraulic system 40 comprises in the shown construction a first hydraulic cylinder 44 connected to the impact plate 24, where the first cylinder may have large inside diameter. The first cylinder 44 has pipe connection to a second cylinder 46, which may preferably have a smaller inside diameter, such that the piston rod movement will be enlarged. The piston rod of the second cylinder 46 is connected to a valve 42 for trigging the release, or the second cylinder 46 may be connected to the pulling wire as explained for FIGS. 2 and 3.

Both the pneumatic and hydraulic solutions can also be used for activating a cutting mechanism (not shown) for cutting the towing hawser 12.

The invention is described above as a mechanical solution. However, it is conceivable that the registration unit is an electrical or electromechanical device which is similarly mounted over the towing hooks 10 range of application, and which, under the influence of vertical angle fluctuation to the towing hook or the towing hawser, is arranged to cause triggering of the releaser, for instance by breaking or terminating a circuit so that a signal is sent to the equipment that triggers the towing hook. The aforementioned power problems can be avoided by using equipment requiring minimal power or by using more power sources.

The invention claimed is:

1. An automatic release system on a supply or tug vessel, comprising a towing hook supported on a vertical axle, for receipt of a towing hawser, and a releasing unit for releasing the towing hawser from the towing hook, wherein a registration unit is installed above a towing hook working area, said registration unit being a tiltable or liftable hoop plate, where the registration unit, under influence of vertical angular movement in a towing hawser's horizontal direction in relation to the towing hook, triggers release of the releasing unit.

2. The automatic release system according to claim 1, wherein the registration unit triggers release of the releasing unit at predetermined maximum bit and trim angles of a vessel dependent on horizontal direction of the towing hawser in relation to a longitudinal or a transverse axis of the vessel.

3. The automatic release system according to claim 1, wherein the registration unit is supported on the vertical axle that supports the towing hook, and rotates together with the towing hook.

4. The automatic release system according to claim 1, wherein the registration unit is skiddably supported on the vertical axle that supports the towing hook, and is liftable under influence of vertical angular movement of the towing hook.

5. The automatic release system according to claim 1, wherein the registration unit is supported on the vertical axle that supports the towing hook, and is tiltable about a rotation point under influence of vertical angular movement of the towing hook.

6. The automatic release system according to claim 1, wherein the registration unit is connected with a linked arm connection to the releasing unit for transfer of a releasing force.

7. The automatic release system according to claim 6, wherein the linked arm connection pulls or releases a releasing wire connected to the releasing unit.

8. The automatic release system according to claim 6, wherein the linked arm connection opens a valve between an accumulator and a cylinder unit, where the cylinder unit activates the releasing unit.

9. The automatic release system according to claim 6, wherein an impact plate is vertically moveable above the registration unit, where the impact plate transfers angular movement of the towing hook from the registration unit to the linked arm connection.

10. The automatic release system according to claim 1, wherein an impact plate is vertically moveable above the registration unit, where the impact plate is connected to a hydraulic system, which activates a valve that releases the releasing unit.

11. The automatic release system according to claim 1, wherein the registration unit is equipped with an upward bolt, where a clearance between the upward bolt and an impact plate provides a desired release angle.

12. The automatic release system according to claim 1, wherein the registration unit is the tiltable or liftable hoop plate and has a partly spherical geometry on an underside.

13. The automatic release system according to claim 1, wherein a clearance between the registration unit and the towing hook gives a desired release angle.

* * * * *